United States Patent [19]

Ebata

[11] 3,969,794

[45] July 20, 1976

[54] CONCEALED ZIPPER FASTENER

[75] Inventor: Hiroyuki Ebata, Uozu, Japan

[73] Assignee: Yoshida Kogyo Kabushiki Kaisha, Japan

[22] Filed: Sept. 16, 1974

[21] Appl. No.: 506,106

Related U.S. Application Data

[63] Continuation of Ser. No. 329,589, Feb. 5, 1973, abandoned.

[30] Foreign Application Priority Data

Feb. 7, 1972 Japan ..... 47-15624

[52] U.S. Cl. ..... 24/205.11 F; 24/205.15 R

[51] Int. Cl.[2] ..... A44B 19/36

[58] Field of Search ..... 24/205.11 F

[56] References Cited

UNITED STATES PATENTS

| | | | |
|---|---|---|---|
| 2,441,007 | 5/1948 | Carlile | 24/205.11 F |
| 3,001,904 | 9/1961 | Porepp | 24/205.11 F |
| 3,309,746 | 3/1967 | Carlile | 24/205.11 F |
| 3,353,233 | 11/1967 | Froalich | 24/205.11 F |
| 3,505,710 | 4/1970 | Froalich | 24/205.11 F |
| 3,672,008 | 6/1972 | Moertel | 24/205.11 F |
| 3,686,719 | 8/1972 | Johnston | 24/205.11 F |

FOREIGN PATENTS OR APPLICATIONS

| | | | |
|---|---|---|---|
| 87,313 | 6/1966 | France | 24/205.11 F |

*Primary Examiner*—Bernard A. Gelak

*Attorney, Agent, or Firm*—Bucknam and Archer

[57] ABSTRACT

A slider locking or retaining means is provided on a concealed type of zipper fastener at a top end thereof for engagement with an element-guide channel defined between a guide post and an inner side wall of the slider. The inner side wall extends substantially parallel with a longitudinal axis of the slider so that the retaining means is held in pressure engagement with the inner side wall and the guide post respectively when external lateral forces are applied to the fastener tapes. This arrangement ensures that the slider is retained in locked position relative to the fastener in its fully closed disposition.

3 Claims, 4 Drawing Figures

CONCEALED ZIPPER FASTENER

This is a continuation, of application Ser. No. 329,589 filed Feb. 5, 1973 now abandoned.

This invention relates to sliding clasp fasteners or zippers, and has particular reference to a zipper fastener of the concealed type which substantially simulates a garment seam in its closed position.

Zipper fasteners having two rows of interlocking elements formed from a single plastic filament and secured to the folded edges of a pair of opposed stringer tapes are well known, and such fasteners when closed by a reciprocating slider mask the elements from external view, only leaving a linear seam in the junction of the opposed tapes.

Various locking means have been proposed for locking or otherwise retaining the slider in stationary position relative to the fastener against unintentional separation of the interlocked fastener stringers.

Some prior-art slides for use with the concealed fasteners are provided with locking pins or prongs for retaining the slider in stopped position against spontaneous displacement. More advanced slider-locking concepts are known which preclude the necessity of the above-mentioned locking pins or prongs and which feature the provision of a "braking" flange at both inlet and outlet sides of the slider for frictional engagement with the stringer tapes adjacent the element-carrying folded edges of the fastener. Since this concept relies solely upon frictional contact between the upper flange members of the slider and the tapes, the slider is prone to retract from its locked position when severe lateral forces are exerted upon the fastener, particularly up above the inlet side of the slider, with the results that the fastener is split open. Furthermore, this type of concealed fastener has the drawback that the slider with its flanges disposed in frictional engaging relation to the tapes is sluggish in its operative movement.

Whereas, it is the primary object of the present invention to provide a concealed zipper fastener of this character which will eliminate the above-noted drawback of the prior-art fastener.

A more specific object of the invention is to provide a concealed zipper fastener which is adapted particularly for articles such as trousers, ladies' one-piece dresses and the like wherein the fastener is normally applied in its fully closed disposition and need not be kept halfway open.

Another specific object of the invention is to provide a concealed zipper fastener of the type just mentioned which is rendered completely resistant to accidental opening even under the influence of severe external stresses tending to force apart the interengaged fastener stringers.

A further specific object of the invention is to provide a novel slider-locking concept whereby the slider on the concealed zipper fastener can maintain its locked position with the fastener fully closed against accidental movement even when lateral forces in the fastener-opening direction are applied to the fastener, particularly at the top end region thereof up above the slider, the said concept precluding the necessity of conventional locking pins or prongs, or such braking flange devices which give undue frictional resistance to the fastener tapes.

A still further specific object of the invention is to provide an improved concealed zipper fastener which upon release of the locking condition of the slider can be opened with utmost ease without having to manipulate the slider.

These and other objects and features of the invention will appear clear as the description proceeds with reference to a specific embodiment shown in the accompanying drawings in which like reference characters refer to like parts throughout the several views and in which.

Figure 1:
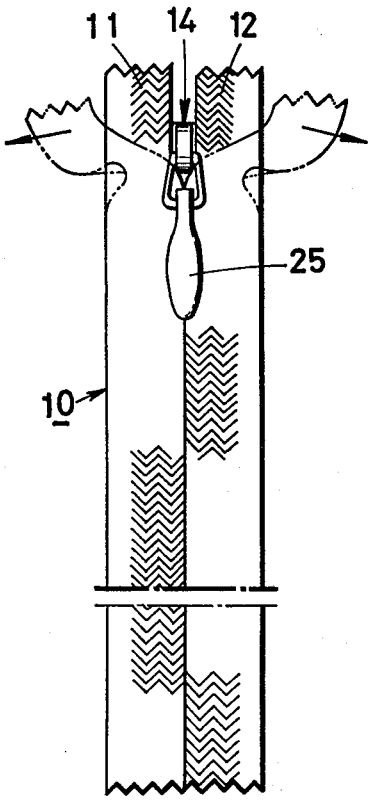
FIG. 1 is a plan view of a concealed zipper fastener to which the principles of this invention are applied.

The fastener generally designated by the reference numeral 10 comprises a pair of opposed stringer tapes 11, 12 each carrying along their respective folded edge 13 a row of fastener elements E. The illustrated fastener elements E are made of a plastic filament formed into a coil in the known manner and are secured by stitchings S to the folded edge portions 13 of the tapes.

There is shown a slider 14 which is mounted astride of the rows of fastener elements E and movable reciprocally therealong to couple and uncouple the elements E, hence the two opposed stringer tapes 11, 12. The slider 14 comprises a plate body 15, a central guide post 16 defining a Y-shaped element-guide channel 17 and side flanges 18 integral with said body.

Figure 4:
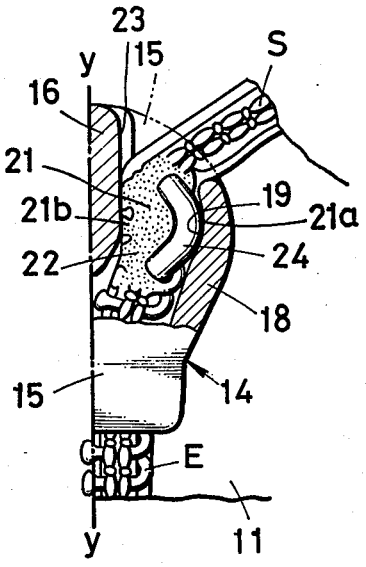
FIG. 4 is a rear view of an important part of a modified embodiment according to the invention.
Figure 2:
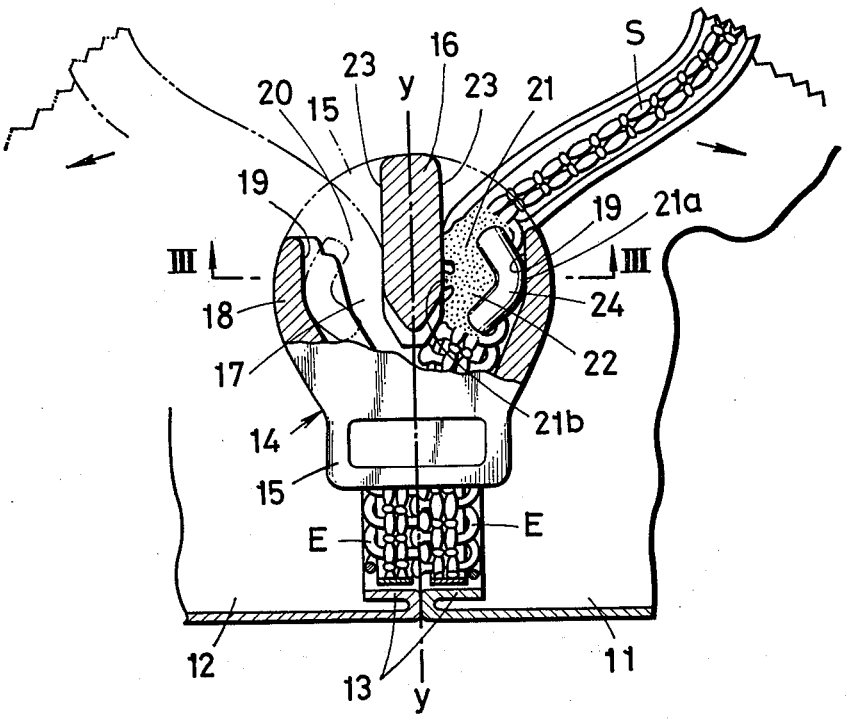
FIG. 2 is a rear view of an important part of the fastener in fully closed disposition with the slider shown partially broken away for a better illustration of the invention.
Figure 3:
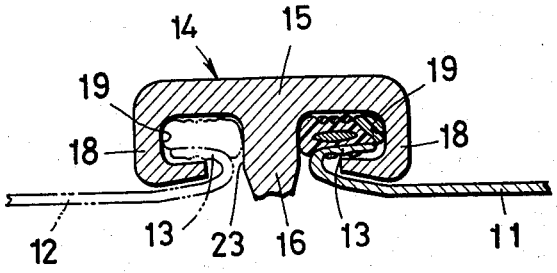
FIG. 3 is a transverse cross-sectional view taken on the line III—III of FIG. 2.

It will be noted that each side flange includes an inner side wall 19 which lies adjacent an inlet 20 of the guide channel 17 and extends substantially parallel with a longitudinal axis y—y of the slider 14 as better seen in FIG. 2 for purposes hereinafter described. Alternatively, the inner side wall 19 may be directed slightly inwardly relative to the longitudinal axis y—y of the slider 14 as shown in FIG. 4.

There is provided a slider locking or retaining means 21 at least on one of the two rows of elements E adjacent a top terminal end thereof for retaining the slider 14 in position against unintentional retractive movement when severe lateral forces are applied to the fastener 10 in the direction of the arrow tending to force apart the two opposed stringer tapes 11, 12. The retaining means 21 preferably comprises a portion 22 of the row of elements E adjacent a top terminal end thereof which is flattened out or otherwise deformed as by heat to expand sidewise to a width substantially equal to or slightly greater or smaller than the width of the guide channel 17 defined between the guide post 16 and the inner side wall 19 of the slider 14. The dimension of the retaining means 21 is such that the same may be introduced in the guide channel 17 with least effort when the fastener is brought into a fully closed position, but opposite longitudinal side edges 21*a* and 21*b* of the means 21 may be held in pressure engagement with the inner side wall 19 of the flange 18 and the side wall 23 of the guide post 16, respectively, when the lateral forces are applied to the stringers 11, 12 in the direction of the arrow. This constitutes an important aspect of the invention in which the forces tending to open apart the closed stringers of the fastener when exerted particularly at the top end region of the fastener above the retaining means 21 are substantially taken up by the retaining means 21 whereupon the respective side edges 21*a*, 21*b* of the means 21 are urged into pressure engagement respectively with the inner side wall 19 of the flange 18 and the side wall 23 of the guide post 16 thereby producing sufficient frictional forces to prohibit the tendency of the slider 14 to move down or retract which would otherwise take place under the influence of component forces tending to draw the slider backward. Where the deformed portion 22 of the elements E is deficient in volume, there may be used a reinfrocing strip 24 as in the illustrated embodiments which is preferably made of a thermoplastic material so as to permit the same to be fused together with the deformed portion 22 and thus anchored in place for abutting engagement with the inner side wall 19 of the flange 18.

Designated at 25 is a pull tab attached to the slider body with which to move the slider along the rows of elements E.

However, it is to be noted that since the slider 14 is held in locked position by the retaining means 21 located at the top end of the fastener and adapted to function only in cooperation with the interior parts of the slider as above described, the slider pull tab 25 need not be manipulated in a prescribed manner for opening the fastener but only appreciable amount of forces in the lateral directon will suffice to disengage the coupled elements once the slider is released from engagement with the retaining means 21.

Having thus described the invention, it will be understood that the invention is not to be limited to the precise details of form and construction illustrated, but various changes and modifications may be made therein without departing from the scope of the appended claims.

What is claimed is:

1. A zipper fastener which comprises a pair of stringer tapes each having an inside edge portion, a row of fastener elements formed from plastic filament and secured to the inside edge portion of each stringer tape, a slider movably mounted on said tapes for coupling and uncoupling said fastener elements and provided centrally with a guide post and side flanges defining therewith guide channels each for the passage of a respective row of fastener elements, said side flanges each having an inner side wall surface which lies adjacent an inlet of a corresponding guide channel and in spaced apart relation to a side wall of said guide post, and retaining means defined by at least one portion of a row of fastener elements deformed into an expanded sidewise configuration disposed for pressure engagement with a respective side wall of the guide post and a respective inner side wall of a side flange to lock the slider against retractive movement in the fully closed disposition of the fastener, said inner side wall surface being oppositely disposed to the guide post and extending substantially parallel with the longitudinal axis of the slider whereby the retaining means is held in pressure engagement with said wall surface and the guide post against the influence of external lateral forces applied to the tapes and tending to open the fastener.

2. A zipper fastener which comprises a pair of stringer tapes each having an inside edge portion, a row of fastener elements formed from plastic filament and secured to the inside edge portion of each stringer tape, a slider movably mounted on said tapes for coupling and uncoupling said fastener elements and provided centrally with a guide post and side flanges defining therewith guide channels each for the passage of a respective row of fastener elements, said side flanges each having an inner side wall surface which lies adjacent an inlet of a corresponding guide channel and in spaced apart relation to a side wall of said guide post, and retaining means defined by at least one portion of a row of fastener elements deformed into an expanded sidewise configuration disposed for pressure engagement with a respective side wall of the guide post and a respective inner side wall of a side flange to lock the slider against retractive movement in the fully closed disposition of the fastener, said inner side wall surface being oppositely disposed to the guide post and extending at an inward inclination to the longitudinal axis of the slider whereby the retaining means is held in pressure engagement with said wall surface and the guide post against the influence of external lateral forces applied to the tapes and tending to open the fastener.

3. A zipper fastener according to claim 1 wherein said retaining means includes a reinforcing strip formed integrally therewith and disposed for engagement with the inner side wall of the slider.

* * * * *